US012117172B1

(12) United States Patent
Crossen

(10) Patent No.: US 12,117,172 B1
(45) Date of Patent: Oct. 15, 2024

(54) DEVICE FOR BLOWING OUT CELEBRATION CANDLES

(71) Applicant: Bridget Ann Crossen, Key Largo, FL (US)

(72) Inventor: Bridget Ann Crossen, Key Largo, FL (US)

(73) Assignee: B. Crossen Design, Inc., Key Largo, FL (US)

( * ) Notice: Subject to any disclaimer, the term of this patent is extended or adjusted under 35 U.S.C. 154(b) by 457 days.

(21) Appl. No.: 17/694,864

(22) Filed: Mar. 15, 2022

Related U.S. Application Data

(60) Provisional application No. 63/162,103, filed on Mar. 17, 2021.

(51) Int. Cl.
*F23Q 25/00* (2006.01)

(52) U.S. Cl.
CPC ..... *F23Q 25/00* (2013.01)

(58) Field of Classification Search
CPC ..... F23Q 25/00
See application file for complete search history.

(56) References Cited

U.S. PATENT DOCUMENTS 1,918,808 A * 7/1933 Gurrell ..... F23Q 25/00 431/145
2,785,556 A * 3/1957 Smith ..... F23Q 25/00 431/290
2,974,438 A * 3/1961 Hopkins ..... A63H 33/28 446/16
3,150,831 A * 9/1964 Bosak ..... F23Q 25/00 124/55
3,227,461 A * 1/1966 Love, Jr. ..... A01C 15/02 222/317
3,905,746 A * 9/1975 Patrikios ..... F23N 5/22 431/290
4,591,071 A * 5/1986 Johnson ..... F41B 9/0018 222/401
4,750,641 A * 6/1988 Chin-Fu ..... F41B 9/0037 446/475
4,767,033 A * 8/1988 Gemperle ..... F04C 15/008 222/383.2
4,865,229 A * 9/1989 Schneider ..... B05C 17/0136 222/391
4,998,645 A * 3/1991 Pearson ..... B65D 35/285 222/391
5,123,598 A * 6/1992 Courtney ..... A01C 7/02 239/526
5,152,461 A * 10/1992 Proctor ..... B05B 11/0064 239/304
5,184,756 A * 2/1993 Amron ..... F41B 9/0018 222/401

(Continued)

*Primary Examiner* — Frederick C Nicolas
(74) *Attorney, Agent, or Firm* — ALBERT BORDAS P.A.

(57) ABSTRACT

A device for blowing out celebration candles, which has an outer casing, a trigger assembly with a trigger and a toothed half wheel, a spring, a cogwheel assembly having first, second, and third cogwheels, an impellor, and an inner casing having a tube. The spring, the cogwheel assembly, the impellor, and the inner casing are incased in the outer casing. The trigger assembly protrudes from the outer casing. The device may be used instead of other methods customary in celebrations such as blowing out candles by mouth.

20 Claims, 3 Drawing Sheets

(56) References Cited

U.S. PATENT DOCUMENTS

| | | | | | |
|---|---|---|---|---|---|
| 5,283,970 | A * | 2/1994 | Aigner | A63H 5/04 | 362/112 |
| 5,975,358 | A * | 11/1999 | Zheng | F41B 9/0018 | 446/15 |
| 6,267,581 | B1 * | 7/2001 | Harrison | F23Q 25/00 | 431/144 |
| 6,921,312 | B2 * | 7/2005 | Thai | A63H 33/28 | 446/176 |
| 6,959,838 | B2 * | 11/2005 | Eddins | F41B 9/0018 | 446/159 |
| 7,325,579 | B2 * | 2/2008 | Harding | A01G 25/145 | 141/2 |
| 2008/0290115 | A1 * | 11/2008 | Amron | F41B 9/0021 | 222/324 |

* cited by examiner

DEVICE FOR BLOWING OUT CELEBRATION CANDLES

BACKGROUND OF THE INVENTION

1. Field of the Invention

The present invention relates to a device for blowing out celebration candles.

2. Other Related Applications

The present Non-Provisional Patent application claims priority of U.S. Provisional Application No. 63/162,103, filed on Mar. 17, 2021, which is hereby incorporated by reference.

3. Description of the Related Art

Currently, there are several solutions for blowing out celebration candles. Some of these solutions attempt to blow on the candle with your mouth, but these solutions fail to meet the needs of the industry because they can expose a dessert to germs and bacteria. Other solutions attempt to wave objects in the air, but these solutions are similarly unable to meet the needs of the industry because it is not entertaining and can be difficult.

SUMMARY OF THE INVENTION

It would be desirable to have a device that prevents contamination of desserts for celebrations when celebratory candles are blown out. Furthermore, it would also be desirable to have a device that is fun and easy to use for all ages. Still, further, it would be desirable to have a device that can be presented in any theme associated with an industry. Therefore, there currently exists a need for a device that blows out celebratory candles. Similarly, it would be desirable to have an associated method for blowing out celebratory candles. Therefore, there currently exists a need for a process that provides an alternative to conventional methods.

The present invention is a device for blowing out celebration candles, comprising an outer casing, a trigger assembly with a trigger and a toothed half wheel, a spring, a cogwheel assembly having first, second, and third cogwheels, an impellor, and an inner casing having a tube. The spring, the cogwheel assembly, the impellor, and the inner casing are incased in the outer casing. The trigger assembly protrudes from the outer casing.

The outer casing comprises an opening. The spring comprises first and second ends defining first and second loops respectively. The trigger assembly comprises an upper structure attached to the trigger, which defines the toothed half wheel and a hook. The spring is attached to the inner casing and the trigger assembly. The first loop of the spring is attached to the hook and the second end is attached to the inner casing. The toothed half wheel is opposite to a grip of the trigger.

The toothed half wheel meets teeth of the first cogwheel. The first cogwheel interlocks with the second cogwheel and the third cogwheel. The second cogwheel is a floating gear allowing to detach from teeth of surrounding first and second cogwheels. The first cogwheel turns the second cogwheel and the second cogwheel turns the third cogwheel, which engages the impellor cogwheel of the impellor. The impellor turns creating an air flow propelled out of the inner casing. The inner casing comprises ventilation holes around the impellor. The outer casing defines a form of a character or toy shapes. The inner casing surrounds the impellor with the spring and the trigger. The tube comprises holes and a support structure to secure the inner casing to the outer casing. The inner casing further comprises a cover positioned over the cogwheel assembly.

The device is adapted to be used whereby the trigger is pulled inward causing the toothed half wheel to engage the first cogwheel stretching the spring. The trigger is released and the spring contracts returning the trigger to prime position. The air flow from the impellor is pushed through the tube and outs from a tube opening, which aligns with the opening on the outer casing.

Similarly, a method for extinguishing celebration candles consists of the following steps and use of a handheld device to discharge air, extinguishing a flame of celebratory candles in a more hygienic manner.

The device may also have one or more of the following: lights, sound, batteries, electrical power, different inside casing shape, color or material, different outside casing shape, color, or material.

Similarly, the associated method may also include one or more of the following steps: using a handheld mechanical devise to propel air for the purpose of extinguishing celebratory candles. The air can be propelled by impellor, suction, pressure, or any other method common to the industry.

The disclosed device is unique when compared with other known devices and solutions because it provides:

(1) a handheld device for blowing out candles;
(2) is fun; and
(3) can be incased in any design appealing to any age.

Similarly, the associated method is unique in that:

(1) provides a way to blow out candles without using your mouth;
(2) not difficult; and
(3) can be used by anyone.

The disclosed device is unique in that it is structurally different from other known devices or solutions. More specifically, the device is unique due to the presence of:

(1) a friction powered mechanism;
(2) the generation of air flow; and
(3) the outer casing resembling ideas commonly used in the industry.

Furthermore, the process associated with the aforementioned device is likewise unique. More specifically, the disclosed process owes its uniqueness to the fact that it:

(1) is generated by a handheld device;
(2) is easy to use; and
(3) is entertaining.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The devise for method of blowing out celebration candles may, however, be embodied in many different forms and should not be construed as being limited to the embodiments set forth herein; rather, these embodiments are provided by way of illustration only and so that this disclosure will be thorough, complete and fully convey understanding to those skilled in the art.

It is therefore one of the main objects of the present invention to provide a device for blowing out celebration candles.

It is another object of this invention to provide a device for blowing out celebration candles, which provides a way to blow out candles without using a mouth.

It is another object of this invention to provide a device for blowing out celebration candles that is volumetrically efficient for carrying, transporting, and storage.

It is another object of this invention to provide a device for a method of blowing out celebration candles that can be readily operated without the need of any special tools.

It is another object of this invention to provide a device for a method of blowing out celebration candles, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
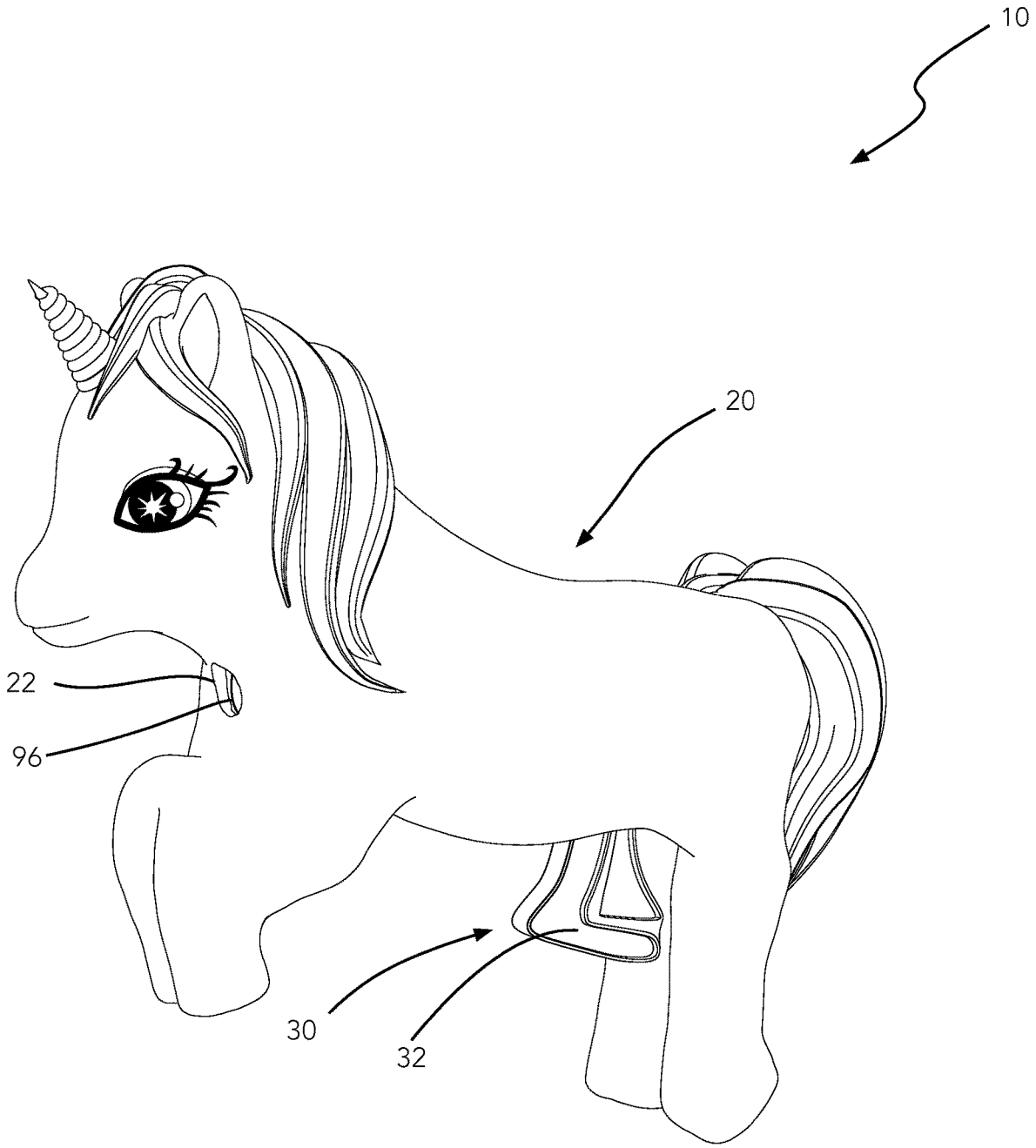
FIG. 1 is an isometric view of the present invention.

Referring now to the drawings, the present invention is a device for blowing out celebration candles and is generally referred to with numeral 10. It can be observed that it basically includes outer casing 20, trigger assembly 30, spring 40, cogwheel assembly 50, impellor 70, and inner casing 80.

Figure 2:
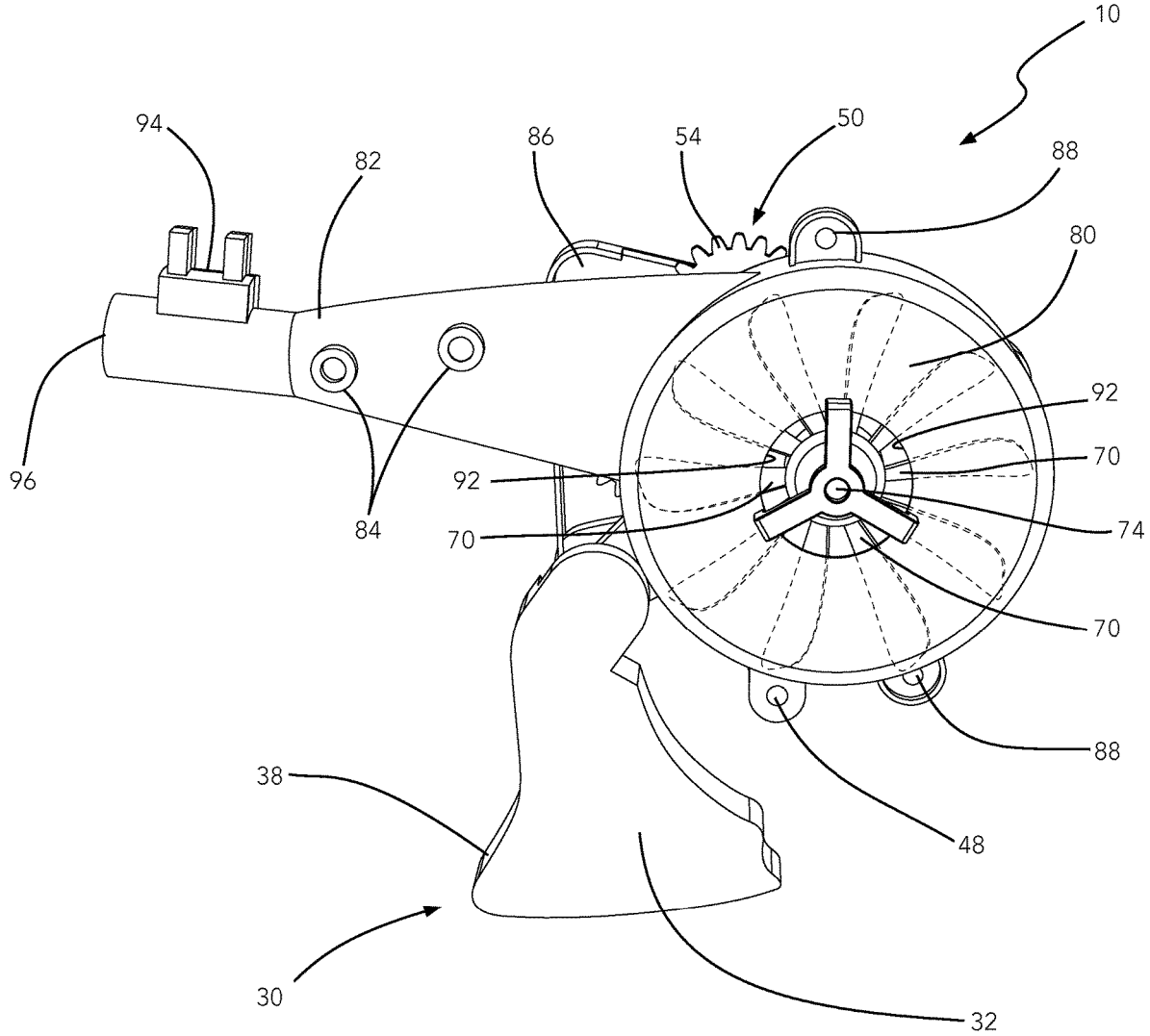
FIG. 2 is a view of a first side of an interior mechanism of one embodiment of the present invention.

As seen in FIGS. 1 and 2, outer casing 20 is in a form of a character or toy shape commonly used in the industry. Outer casing 20 comprises opening 22 for air to exit the exterior. Character or toy shapes may be dragons, dogs, etc. Present invention 10 comprises trigger assembly 30, which protrudes from outer casing 20. An interior mechanism includes inner casing 80 and trigger assembly 30. Inner casing 80 comprises tube 82, cover 86, holes 88, screws 90, seen in FIG. 3, and ventilation holes 92. Inner casing 80 is attached to outer casing 20. Tube 82 comprises holes 84. Holes 84 allow to secure inner casing 80 to outer casing 20, whereby holes 84 receive respective screws, not seen, which anchors and stabilizes inner casing 80 to outer casing 20. Inner casing 80 further comprises support structure 94 to secure inner casing 80 inside outer casing 20. Ventilation holes 92 are around impellor 70. Ventilation holes 92 allow air flow.

Outer casing 20 is large enough to fit the mechanism inside of it, but small enough to be held in a child's hand. It should further be noted that materials common to the industry such as polyolefins (polyethylene, polypropylene, EVA, etc.), styrene derived polymers (PS, ABS, SB, etc.) and plasticized PVC or any other materials common to the industry can be used in manufacturing the device of present invention 10, as well as any method common in the industry for manufacturing and/or fastening of such parts. The most complete form of performing the method associated with the disclosed device consists of the following steps using a handheld mechanical devise to blow out celebratory candles. It should further be noted that: this includes the use of a mechanical fan.

Figure 3:
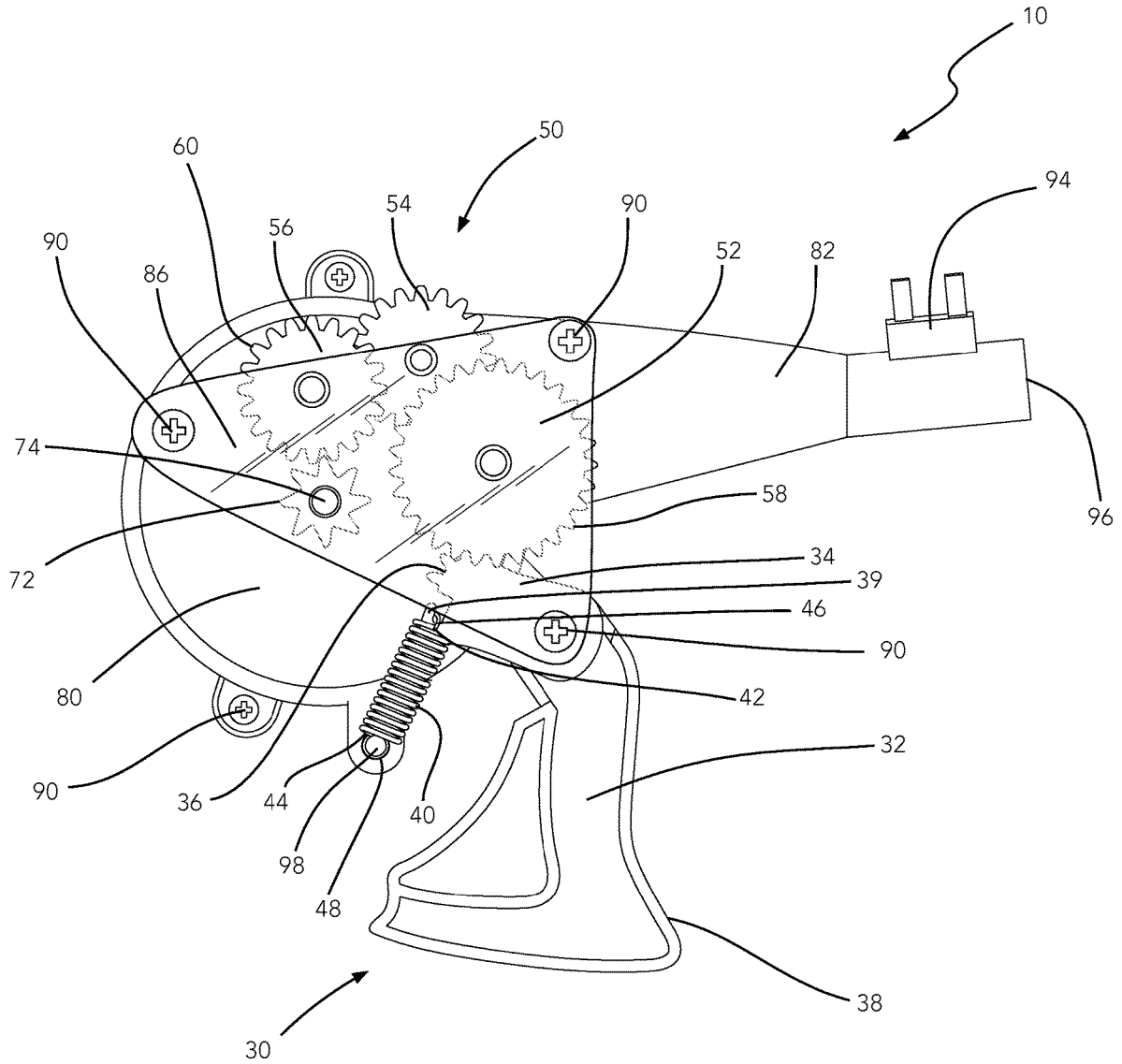
FIG. 3 is a view of a second side of the interior mechanism of one embodiment of the present invention seen in FIG. 2.

As seen in FIGS. 2 and 3, trigger assembly 30 comprises trigger 32, upper structure 34, and toothed half wheel 36. Upper structure 34 is attached to trigger 32 and defines toothed half wheel 36 and hook 39. Spring 40 comprises first end 42 and second end 44 having first loop 46 and second loop 48 respectively. Spring 40 is attached to trigger assembly 30 and inner casing 80. First end 42 of spring 40 is attached to upper structure 34 and second end 44 is attached to inner casing 80, whereby first loop 46 is attached to hook 39 and second loop 48 is attached to pin 98. Toothed half wheel 36 is opposite to grip 38 of trigger 32. Cogwheel assembly 50 comprises first cogwheel 52, second cogwheel 54, and third cogwheel 56. Toothed half wheel 36 is positioned next to first cogwheel 52. Toothed half wheel 36 meets teeth 58 of first cogwheel 52. First cogwheel 52 interlocks with second cogwheel 54 and third cogwheel 56. Cover 86 is positioned over cogwheel assembly 50. In a preferred embodiment, cover 86 is secured by screws 90. Impellor 70 comprises impellor cogwheel 72 and shaft 74. Inner casing 80 surrounds impellor 70 with spring 40 and trigger assembly 30 attached.

Trigger 32 is pulled inward causing toothed half wheel 36 to engage first cogwheel 52 and stretching spring 40. Trigger 32 is released and spring 40 contracts returning trigger 32 to prime position. First cogwheel 52 turns second cogwheel 54, which is a floating gear, allowing it to detach from teeth 58 and 60 of surrounding cogwheels 52 and 56, respectively, and reposition itself without disrupting the motion of surrounding cogwheels 52 and 56. The floating gear or second cogwheel 54 turns third cogwheel 56, which engages impellor 70, specifically impellor cogwheel 72. Impellor 70 turns creating air flow. Impellor cogwheel 72 is fixedly mounted to shaft 74. The air is propelled out of inner casing 80. The air from impellor 70 is pushed through tube 82 and outs from tube opening 96, which aligns with opening 22 in outer casing 20, seen in FIG. 1.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for blowing out celebration candles, comprising:

A) an outer casing;

B) a trigger assembly with a trigger and a toothed half wheel;

C) a spring;

D) a cogwheel assembly having first, second, and third cogwheels;

E) an impellor; and

F) an inner casing having a tube, whereby said spring, said cogwheel assembly, said impellor, and said inner casing are incased in said outer casing, and said trigger assembly protrudes from said outer casing.

2. The device for blowing out celebration candles set forth in claim 1, wherein said outer casing comprises an opening.

3. The device for a method of blowing out celebration candles set forth in claim 1, wherein said spring comprises first and second ends defining first and second loops respectively.

4. The device for blowing out celebration candles set forth in claim 3, wherein said trigger assembly comprises an upper structure attached to said trigger, which defines said toothed half wheel and a hook.

5. The device for blowing out celebration candles set forth in claim 1, wherein said spring is attached to said inner casing and said trigger assembly.

6. The device for blowing out celebration candles set forth in claim 4, wherein said first loop of said spring is attached to said hook and said second loop is attached to said inner casing.

7. The device for blowing out celebration candles set forth in claim 1, wherein said toothed half wheel is opposite to a grip.

8. The device for blowing out celebration candles set forth in claim 1, wherein said toothed half wheel meets teeth of said first cogwheel.

9. The device for blowing out celebration candles set forth in claim 1, wherein said first cogwheel interlocks with said second cogwheel and said third cogwheel.

10. The device for blowing out celebration candles set forth in claim 1, wherein said second cogwheel is a floating gear allowing to detach from teeth of surrounding said first and second cogwheels.

11. The device for blowing out celebration candles set forth in claim 1, wherein said first cogwheel turns said second cogwheel.

12. The device for blowing out celebration candles set forth in claim 1, wherein said second cogwheel turns said third cogwheel, which engages with said impellor cogwheel of said impellor.

13. The device for blowing out celebration candles set forth in claim 2, wherein said impellor turns creating an air flow propelled out of said inner casing.

14. The device for blowing out celebration candles set forth in claim 1, wherein said inner casing comprises ventilation holes around said impellor.

15. The device for blowing out celebration candles set forth in claim 1, wherein said outer casing defines a form of a character or toy shapes.

16. The device for blowing out celebration candles set forth in claim 1, wherein said inner casing surrounds said impellor, said spring, and said trigger.

17. The device for blowing out celebration candles set forth in claim 1, wherein said tube comprises holes and a support structure, which allow to secure said inner casing to said outer casing.

18. The device for blowing out celebration candles set forth in claim 1, wherein said inner casing further comprises a cover positioned over said cogwheel assembly.

19. The device for blowing out celebration candles set forth in claim 1, wherein said device is adapted to be used whereby said trigger is pulled inward causing said toothed half wheel to engage said first cogwheel stretching said spring, said trigger is released and said spring contracts returning said trigger to a prime position.

20. The device for blowing out celebration candles set forth in claim 13, wherein said air flow from said impellor is pushed through said tube and outs from a tube opening, which aligns with said opening on said outer casing.

* * * * *